US005522648A

United States Patent [19]

Wilen

[11] Patent Number: 5,522,648

[45] Date of Patent: Jun. 4, 1996

[54] REVERSIBLE MOP

[75] Inventor: Joseph M. Wilen, Atlanta, Ga.

[73] Assignee: The Wilen Companies, Incorporated, Atlanta, Ga.

[21] Appl. No.: 331,130

[22] Filed: Oct. 28, 1994

[51] Int. Cl.[6] ..... A47L 13/24

[52] U.S. Cl. ..... 300/21; 15/229.4; 15/229.8

[58] Field of Search ..... 15/226, 228, 229.1, 15/229.2, 229.3, 229.4, 229.5, 229.6, 229.7, 229.8, 229.9; 300/21

[56] References Cited

U.S. PATENT DOCUMENTS

| | | | |
|---|---|---|---|
| 259,807 | 6/1882 | Brown | 15/226 |
| 2,755,498 | 7/1956 | Park | 15/229.8 |
| 2,831,207 | 4/1958 | Thompson | 15/228 |
| 3,711,885 | 1/1973 | Griffin | 15/229.4 |
| 3,787,919 | 1/1974 | Siemund . | |
| 3,806,982 | 4/1974 | Park . | |
| 3,822,435 | 7/1974 | Moss | 15/229.8 |
| 3,872,536 | 3/1975 | Siemund . | |
| 3,945,736 | 3/1976 | Rittenbaum | 15/229.4 |
| 3,986,225 | 10/1976 | Komatsu . | |
| 4,114,223 | 9/1978 | Buchanan | 15/228 |
| 4,715,081 | 12/1987 | Welch | 15/229.8 |
| 5,084,171 | 1/1992 | Murphy et al. . | |
| 5,398,492 | 3/1995 | Thomas | 15/229.1 |

FOREIGN PATENT DOCUMENTS

| | | | |
|---|---|---|---|
| 5146388 | 6/1993 | Japan | 15/228 |

*Primary Examiner*—David Scherbel
*Assistant Examiner*—Randall E. Chin
*Attorney, Agent, or Firm*—Hopkins & Thomas

[57] ABSTRACT

An improved reversible dust mop cover comprises overlying sections of mop cover material having tufted yarns or other mopping medium exposed on both sides thereof. The cover is open on one end, closed along two sides, and its other end is formed by an integral fold line that connects the overlying sections. The cover is made by folding an elongated strip of mop cover material onto itself and securing the two aligned edges of the folded strip together while leaving the end detached. Access openings are formed in the top and bottom sections of the pouch to provide access to the handle receiving bar of a mop frame inserted into the pouch. In use, the mop cover is installed on a mop frame and used until one side becomes soiled whereupon the mop cover is removed and reversed so that the unsoiled side can be used to continue mopping.

8 Claims, 3 Drawing Sheets

REVERSIBLE MOP

TECHNICAL FIELD

This invention relates generally to mops, and more particularly to dust mops of the type commonly used for cleaning and dusting a floor.

BACKGROUND OF THE INVENTION

Dust mops have long been used in industrial applications such as in warehouses, schools, and stores as a means of dusting and cleaning the floor quickly and easily. The common industrial dust mop is used with a generally rectangular wire frame having a central handle receiving bar to which one end of a long handle can be releasably attached. Washable or discardable mop covers are removably mounted on the frame. In general, such mop covers comprise a fabric backing supporting a tufted bottom surface including either a multitude of tufted yarns or mop fringe sewn to the backing, both types forming a field of mopping yarns that contact and dust as the mop is pushed across the floor. The mop cover can be releasably mounted to the frame by any number of attaching means including tie strings, mechanical snaps, pockets that receive the ends of the frame of the mop, or combinations of both. With this arrangement, mop covers can be fixed to the mop frame, used to mop the floor and, when soiled, can be removed and washed for reuse, or discarded.

Such dust mops, however, exhibit inherent shortcomings related generally to the fact that the mopping surface is provided only on the bottom of the mop cover. This limits the usefulness of the covers since they must be removed and cleaned when the mopping surface gets soiled. Further, workers tend to keep using the mops after they become too soiled to be effective, to avoid the task of removing and replacing the soiled cover.

Some attempts have been made to address such shortcomings by providing mops with reversible mop covers having a mopping surface on both the top and bottom side of the cover. One example of such a mop is disclosed in U.S. Pat. No. 4,114,223 to Buchanan. This mop includes a specially formed mop frame and handle assembly adapted to receive on its frame a two sided mop cover that is formed in a shape of an elongated envelope. The mop handle is specifically designed to be pivoted through a slot in the back side of the mop frame to either side thereof. The envelope-shaped mop cover is sized to be inserted over the front edge of the mop frame to cover the frame. The cover is provided with slots that correspond to and align with the slot in the mop frame to allow the mop handle to pivot back and forth through the cover and through the frame. In this way, the mop can be reversed for use of either side of the cover by turning the entire assembly over.

While this device represents an improvement over single sided dust mops, it nonetheless exhibits certain problems and shortcomings inherent in its own design. For example, since the two sided mop cover is shaped as an elongated envelope with an open side that is slipped over the front edge of the mop frame, the cover must be attached to the frame by means of tie strings or other fasteners. This is because as the mop is pulled backwards across a surface, the friction between the mop cover and the surface tends to pull the mop cover forward off of the front edge of the mop frame. Thus, changing the mop cover remains an unwelcome task since the tie strings tend to become knotted and difficult to untie.

In addition, the device of the Buchanan patent requires a specially made, pivoting mop frame that is not of the most commonly used or standard configuration. Thus, a user must also purchase special mop handles and mop frames as well as mop covers in order to use the Buchanan device.

Other examples, of attempts to provide two sided mops are disclosed in U.S. Pat. No. 3,787,919 and U.S. Pat. No. 3,872,536, both to Siemund. These patents disclose sponge mops in which more than one side of a sponge can be used to clean a floor. Both of these patents illustrate fairly complex and custom made devices that are not adapted for use as industrial dust mops.

Thus, there exists a continuing and heretofore unaddressed need for a two sided, reversible dust mop cover that fits on and works with standard industrial mop frames. Such a cover should be easily installable on standard mop frames without the absolute need for tie strings or other fasteners, should include on both sides a mopping medium such as tufted of a wound fringe of yarns, should be easily removed and turned over for use of its clean side when the other side becomes soiled, and should be able to be manufactured efficiently and economically. It is to the provision of such a reversible mop cover that the present invention is primarily directed.

SUMMARY OF THE INVENTION

The present inventions in one preferred embodiment thereof, comprises an improved double sided reversible dust mop cover for use with industrial dust mops. The invention also contemplates an improved method of making such a dust mop cover. The method comprises the steps of providing an elongated strip of mop cover material having a backing, from one side of which a mopping medium such as a field of tufted yarns or yarn fringe project. The strip of mop cover material has a length substantially twice that of the desired length of the finished mop cover. A fold line is selected midway between the ends of the strip to define first and second sections of the strip, and the strip is folded over onto itself along the fold line so that the mopping medium is exposed on both sides of the folded strip. The side edges of the folded sections are then sewn together along their lengths while the aligned ends of the sections are left detached. This forms an open ended pocket configuration of the mop cover. Yarn fringe strips can be secured by sewing or otherwise along the two edges of the cover to provide leading and trailing yarn manes to improve the mopping process.

With the open ended pocket-shaped mop cover formed, access openings are cut through both the top and bottom sections of the mop cover. The access openings are centrally positioned to align with the mop handle receiving bar on a mop frame over which the cover has been applied. Thus, the access opening the top section of the mop cover is aligned with the access opening in the bottom section of the cover. The access openings preferably are serged about their peripheries to increase strength and inhibit unraveling of the backing material in the vicinity of the opening.

In use, the mop cover of this invention is slipped onto a standard industrial mop frame by removing the handle from the frame and sliding the cover over the frame until the handle receiving bar on the frame aligns with the access opening in the upper section of the cover. The handle can then be releasably attached at one of its ends to the handle receiving bar through the access opening. The mop is then ready for use and can be pushed across the floor in the normal way for dusting and cleaning. When the bottom surface of the mop cover becomes too soiled to be effective, the user need only remove the handle, slip the cover off of the frame, flip the cover over, reinsert the frame, and reattach the handle. Otherwise, if the frame retaining bar is positioned so as not to contact the floor when the frame is flipped over, the entire assembly, frame and mop cover, simply can be flipped over and the handle reattached through the opposing opening. This presents the unused reverse side of the cover to the floor so that the user can continue mopping in the normal way. When both sides of the cover become soiled, the cover can be removed and washed or discarded as desired.

It will thus be seen that the present invention includes an improved reversible dust mop cover and an improved method of making same. The method of this invention offers distinct advantage in the manufacturing process, since existing machinery can be used in an efficient and economical way to produce covers. Other advantages include a reduction in raw materials compared to the use of one sided mops, the user requirement for only half as many mop covers as with one sided mops, and a significant reduction in the water, chemicals, and time required for laundering soiled mop covers. In addition, shipping and freight costs are reduced and workers tend to do a better job of cleaning the floor with mops of this invention since they can readily reverse the mop cover to present a clean mopping surface to the floor rather than using an over-soiled, single sided mop. These and other feature and advantages will become apparent upon review of the detailed description set forth below taken in conjunction with the accompanying drawings, which are briefly described as follows.

DETAILED DESCRIPTION OF THE PREFERRED EMBODIMENT

Figure 1:
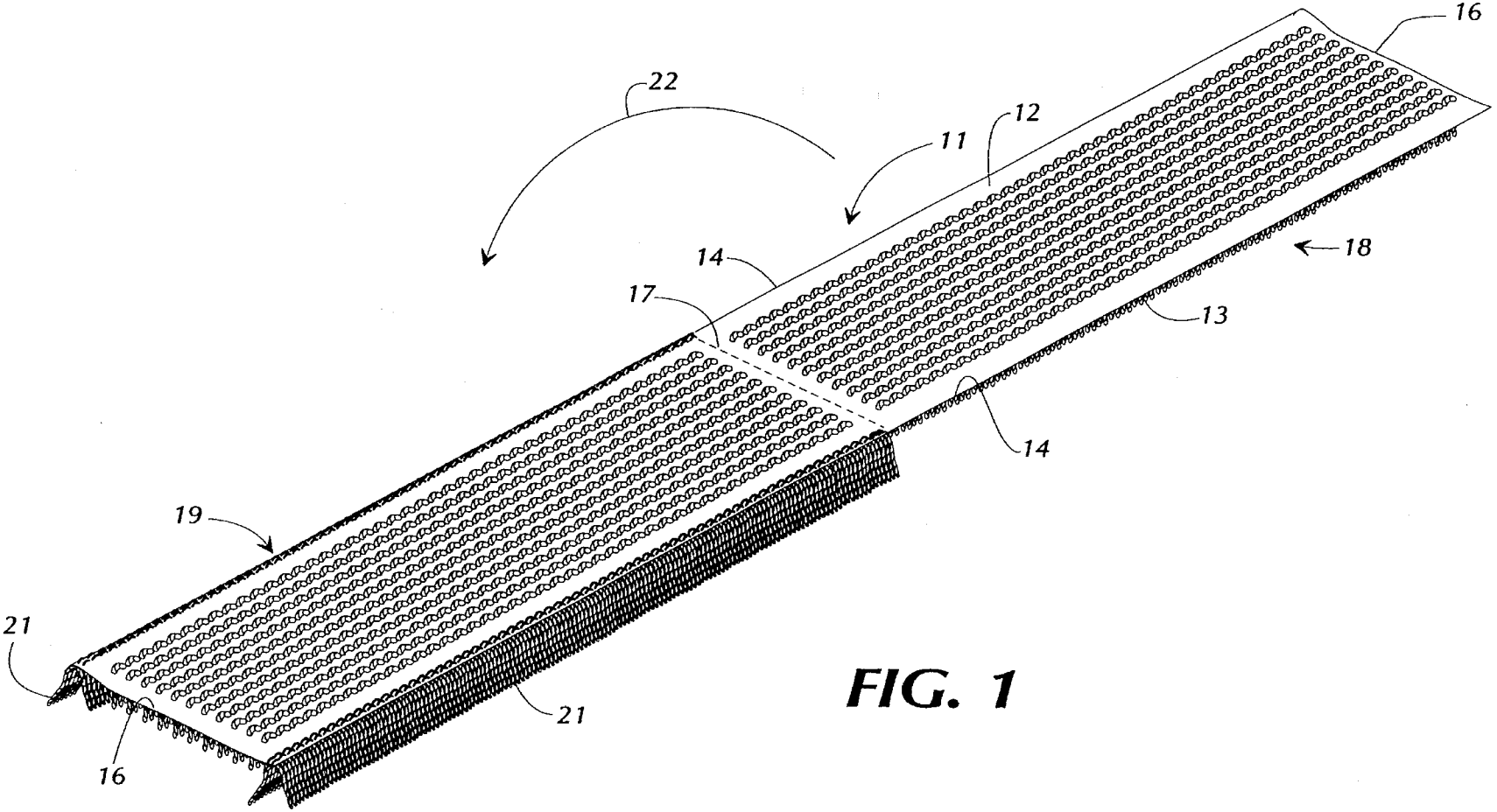
FIG. 1 is an exploded perspective view of one embodiment of a mop cover of the present invention.

Referring now in more detail to the drawings, in which like numerals refer to like parts throughout the several views, FIG. 1 illustrates a partially finished reversible mop cover that embodies principles of the present invention in a preferred form. The method of making the mop cover includes providing an elongated substantially rectangular strip 11 of mop cover material. The strip 11 comprises a backing 12, which can be a heavy canvas or other suitable material. The backing 12 is tufted to provide a shag field of yarns 13 that projects from one side of the strip 11 and that defines a mopping medium for mopping the floor. While the dust mop cover of the preferred embodiment is a tufted yarn mop, it will be understood by those of skill in this art that a variety of other mopping media could be provided on the backing within the scope of this invention. Thus, the mopping medium might be provided by attaching presewn yarn fringe to the backing, or by tufting looped yarns sewn through the backing, or by any other suitable method of providing a floor mopping medium. Thus, the term "mopping medium" when used in the specification and claims herein should be understood to encompass any type of configuration that provides a surface for mopping and cleaning the floor.

The strip 11 is cut to a pre-established length that is approximately twice the length of the finished mop cover to be formed. When so cut, the strip 11 has opposed longitudinally extending side edges 14 and opposed substantially laterally extending end edges 16. A laterally extending fold line 17 is selected to be midway between the two end edges 16 of the strip 11. The fold line 17 divides the strip 11 into a first section 18 and a similar second section 19. Preferably, a fringe yarn strip 21 is secured by sewing or otherwise along the opposed side edges of the second section 19. Alternatively, the fringe yarn strips 21 could be attached along the side edges of the first section 18 or one could be attached along a side edge of the first section and the other attached along the opposed side edge of the second section. As discussed in more detail below, as in prior mops the fringe yarn strips 21 provide a yarn mane on the leading and trailing edges of the mop cover to improve mopping action when the mop is completed and in use.

Figure 2:
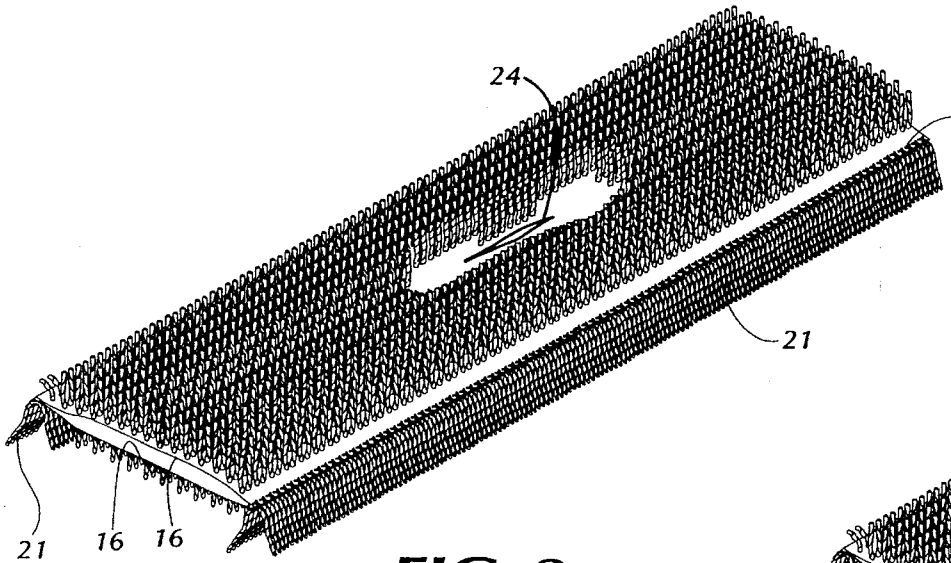
FIG. 2 is a perspective view showing a finished, double sided mop cover made by one method of the present invention.

With the fringe yarns strips 21 attached and the fold line 17 selected, the strip 11 is folded over onto itself in the direction indicated by arrow 22 until the first section 18 overlies the second section 19 with the side edges 14 and end edges 16 of the two sections aligned with each other. This configuration is best illustrated in FIG. 2. The aligned side edges 14 are then secured together, preferably by means of stitching as indicated at 23 in FIG. 2. The end edges 16 of the folded strip are not stitched together but are left detached. This forms an opened-ended pocket configuration of the mop cover with one end being open and the other end being defined by the integral fold line 17 between the first and second sections of the strip. It can be seen from FIGS. 2–4 that when the mop cover is formed as just discussed, the yarn manes formed by the fringe yarn strips 21 extend along the entire length of the front and rear edges of the mop cover to provide leading and trailing mopping surfaces on the cover.

Figure 3:
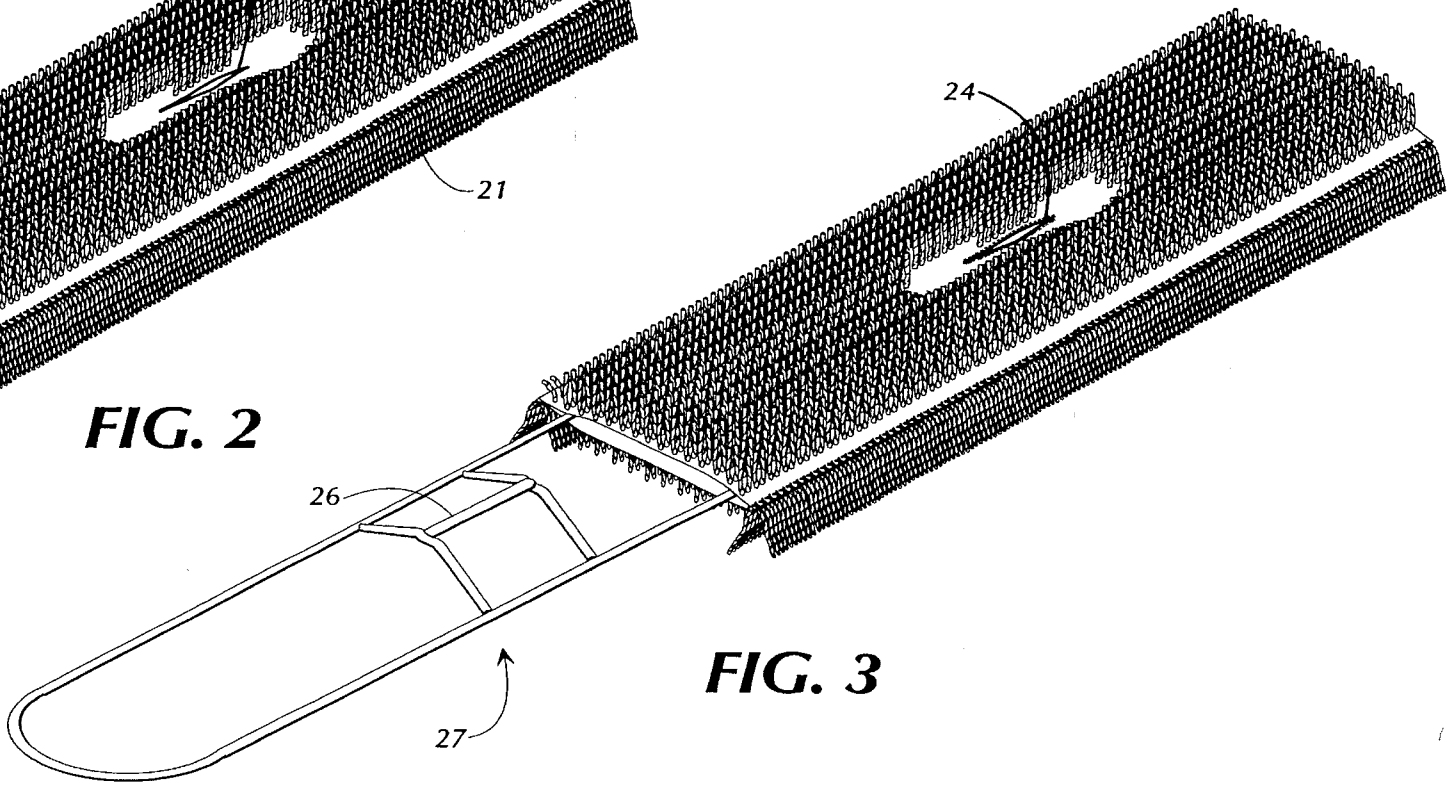
FIG. 3 illustrates the placing of the mop cover of FIG. 2 onto a standard, industrial wire mop frame.
Figure 4:
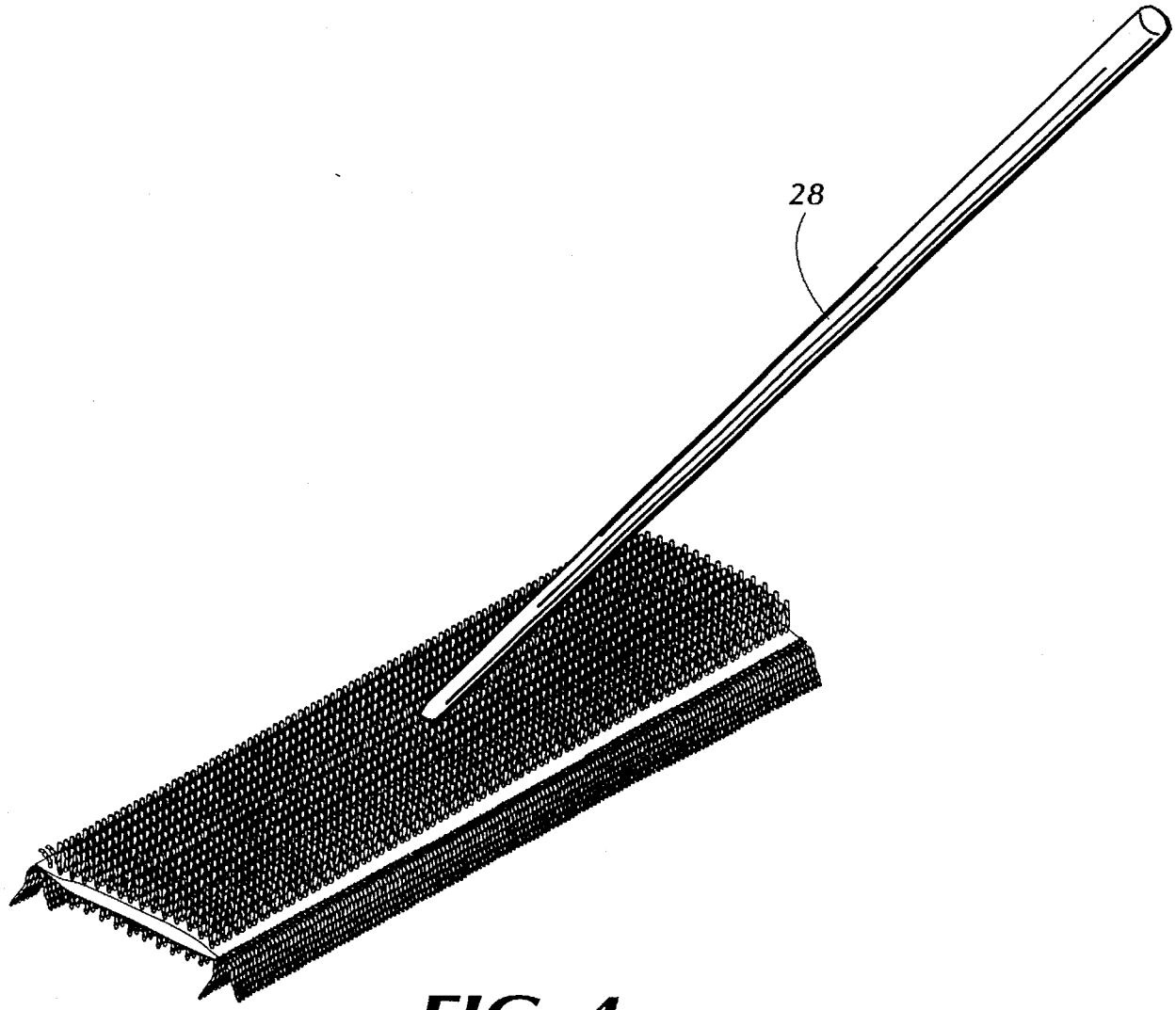
FIG. 4 illustrates the completed dust mop with the mop handle attached to the handle receiving bar of the frame through the access opening in the top section of the mop cover.

Access openings 24 (FIG. 2) are formed by cutting through both the first and second sections of the reversible mop cover. The access openings 24 are aligned with each other and are centrally positioned to provided access to the handle receiving bar 26 of a mop frame 27 (FIG. 3) when the mop cover is fully inserted over the frame. Preferably, the access openings 24 are stitched or serged about their peripheries to strengthen the openings and inhibit unraveling of the backing material in the vicinity thereof. Use of the mop cover of this invention is best illustrated in FIGS. 3 and 4. The mop cover is installed on the frame 27 of a standard dust mop by inserting the frame through the open end of the cover until the cover envelopes the frame and the handle receiving bar 26 of the frame aligns with one of the access openings 24. With the frame 27 fully inserted in the cover, the handle is removably attached at its lower end to the handle receiving bar through the access opening 24 in the top section of the cover. Thus, a traditional dust mop configuration is formed. The user then grasps the handle and pushes the mop across the floor to clean dust and dirt from the floor.

When the bottom side of the dust mop becomes soiled during use, thus reducing its efficiency, the user need only detach the handle 28, remove the cover from the frame 27, flip the cover over, reinstall it on the framed and reattach the handle through the access opening in the soiled side of the cover. In this way, the mop is quickly and easily converted from a soiled condition to a fresh condition for continued mopping. When both sides of the mop become soiled, the mop cover can simply be removed and washed in the normal way for future use. As previously discussed, however, the mop cover need not be removed from the frame if the handle receiving bar of the frame is disposed so as not to contact the floor when the frame is flipped over. Instead the entire assembly, mop cover and frame, can be flipped over and the handle reattached through the opposing access opening so that mopping can continue with the clean side of the mop cover.

Since the mop frame 27 is inserted longitudinally through an end of the mop cover, the force of friction when the mop cover is moving back and forth across the floor does not tend to dislodge the cover from the frame. Thus, no string ties or other attaching means is required to keep the cover in place. In addition, the handle 28 extending through the access opening 24 tends to hold the cover longitudinally in place on the frame against any tendency for it to slide off the frame in that direction.

The invention has been described herein in terms of preferred embodiments and methodologies. It will be obvious to those of skill in this art, however, that numerous additions, deletions and modifications might well be made to the illustrated embodiments within the scope of the invention. For example, while the invention has been illustrated in terms of an industrial tufted dust mops the process may also be applied to other types of mops that may or may not be tufted or may or may not be used for industrial dust mopping. Further, the cover might be formed in the shape of an elongated envelope with one of its sides open rather than one of its ends. These and other modifications might become apparent to those of skill in this art and might be employed without departing from the spirit and scope of the invention as set forth in the claims.

I claim:

1. A method of making a reversible mop cover adapted to be removably installed from one end of an elongated mop frame having a central mop handle receiving bar, said method comprising the steps of:

(a) providing an elongated strip of mop cover material having a length substantially double the length of the finished mop cover to be made, said strip of mop cover material having longitudinally extending opposed side edges, including a first side edge, and a second side edge joined at their ends by end edges extending substantially perpendicular to said first side edge and to said second side edge, the mop cover material having a front surface provided with a mopping medium and a back surface opposite the front surface;

(b) selecting a substantially laterally extending fold line on the strip of mop cover material, said fold line positioned approximately midway between the end edges of the strip extending from the first side edge to the second side edge of the mop cover material and in a direction substantially parallel to the end edges, the fold line separating said strip of mop cover material into first and second sections;

(c) folding the strip of mop cover material onto itself, in a direction transverse to the first and second side edges of said strip of mop cover material along the fold line so that the first section of the strip overlies the second section of the strip with the side and end edges of the sections being substantially aligned and with the mopping medium being exposed on both sides of the folded strip;

(d) securing each of the side edges of the first section of the strip of mop cover material to the corresponding substantially aligned side edges of the second section of the strip while leaving the substantially aligned end edges of the sections detached to form an elongated mop cover having a pocket configuration defining one end entirely open and adapted to be received onto the frame of a mop from an end of the frame; and (e) forming an access opening in the first section of the strip and forming an access opening in the second section of the strip, the access openings being aligned one with the other and being positioned on the sections to provide access to the mop handle receiving bar of a mop frame onto which the mop cover has been fully received.

2. The method of claim 1 and where in step (a) the mopping medium comprises a field of tufted yarn fixed to the front surface of the strip.

3. The method of claim 1 and where in step (a) the mopping medium comprises a plurality of pre-formed yarn fringe strips secured to the front surface of the strip.

4. The method of claim 1 and wherein step (e) further comprises serging the perimeter of the access openings formed in the first and second sections to strengthen the openings and inhibit unraveling of the mop cover material in the vicinity of the access openings.

5. The method of claim 1 and wherein step (d) comprises sewing the aligned first and second side edges of the first and second sections together along their lengths.

6. The method of claim I and further comprising the step of securing a strip of fringe yarns along at least a portion of the length of each of the side edges of the elongated strip of mop cover material to provide yarn manes along the side edges of the mop cover.

7. The method of claim 6 and wherein the strips of fringe yarns are secured along the lengths of the opposed side edges of one of the sections of the elongated strip of mop cover material.

8. The method of claim 7 and wherein the strips of fringe yarns are secured prior to step (c).

* * * * *